US007060998B2

(12) United States Patent
Forrest et al.

(10) Patent No.: US 7,060,998 B2
(45) Date of Patent: Jun. 13, 2006

(54) COMPONENT SUPPORT AND RADIOISOTOPE GENERATOR INCLUDING ONE OR MORE COMPONENT SUPPORTS

(75) Inventors: Terence Robert Frederick Forrest, Amersham (GB); Mark Teucher, Bristol (GB); Philip Walsh, Bristol (GB)

(73) Assignee: GE Healthcare Limited, Buckinghamshire (GB)

( * ) Notice: Subject to any disclaimer, the term of this patent is extended or adjusted under 35 U.S.C. 154(b) by 0 days.

(21) Appl. No.: 10/508,718

(22) PCT Filed: Dec. 11, 2002

(86) PCT No.: PCT/GB02/05624

§ 371 (c)(1),
(2), (4) Date: Sep. 20, 2004

(87) PCT Pub. No.: WO03/081055

PCT Pub. Date: Oct. 2, 2003

(65) Prior Publication Data

US 2005/0104016 A1 May 19, 2005

(30) Foreign Application Priority Data

Mar. 20, 2002 (GB) ..... 0206550.6

(51) Int. Cl.
*G21F 5/00* (2006.01)

(52) U.S. Cl. ..... 250/506.1; 250/428; 250/505.1; 250/507.1; 250/522.1; 250/526

(58) Field of Classification Search ..... 250/432 PD, 250/432 R, 308, 428, 430, 433–436, 493.1, 250/496.1, 497.1, 506.1, 507.1, 515.1; 403/13, 403/14, 252, 316, 319, 254; 24/625, 662, 24/664, 665; 141/DIG. 2
See application file for complete search history.

(56) References Cited

U.S. PATENT DOCUMENTS

| | | | | |
|---|---|---|---|---|
| 2,340,423 | A | 2/1944 | Desso et al. | |
| 2,826,110 | A | 3/1958 | Lemelson | |
| 3,564,256 | A * | 2/1971 | Arlman et al. | 250/432 R |
| 3,888,595 | A * | 6/1975 | Morris | 403/14 |
| 3,946,238 | A | 3/1976 | Fries | |
| 3,956,603 | A * | 5/1976 | Fisher | 200/61.58 B |
| 4,081,915 | A * | 4/1978 | Materniak nee Babcerowicz et al. | 34/235 |
| 4,387,303 | A | 6/1983 | Benjamins | |
| 4,832,641 | A * | 5/1989 | Oishi et al. | 440/88 R |
| 4,844,645 | A | 7/1989 | Rasmussen | |
| 4,908,917 | A * | 3/1990 | Kazle | 24/615 |
| 4,955,743 | A * | 9/1990 | King | 403/254 |
| 5,826,309 | A * | 10/1998 | Tsamas | 24/68 J |

(Continued)

FOREIGN PATENT DOCUMENTS

DE 4032565 4/1992

(Continued)

OTHER PUBLICATIONS

International Search Report for PCT/GB02/05624 dated Apr. 4, 2003.

(Continued)

*Primary Examiner*—John R. Lee
*Assistant Examiner*—Bernard E. Souw
(74) *Attorney, Agent, or Firm*—Robert F. Chisholm

(57) ABSTRACT

The invention relates to a component support (29) for use in a radioisotope generator, the component support comprising a latching member (5) movable between an engaging position and an open position characterised by further including a bracing member (13) mechanically associated with the latching member and adapted to prevent movement of the latching member to the open position.

9 Claims, 1 Drawing Sheet

U.S. PATENT DOCUMENTS

| | | | | |
|---|---|---|---|---|
| 5,871,320 | A | 2/1999 | Kovac | |
| 5,931,529 | A * | 8/1999 | LaPointe et al. | 297/248 |
| 2005/0104016 | A1* | 5/2005 | Forrest et al. | 250/506.1 |

FOREIGN PATENT DOCUMENTS

| | | |
|---|---|---|
| EP | 0434978 | 1/1993 |
| EP | 0744805 | 9/1998 |
| EP | 0902197 | 2/2001 |
| FR | 2665493 | 2/1992 |
| GB | 2009912 | 6/1979 |
| WO | 8002082 | 10/1980 |

OTHER PUBLICATIONS

Great Britain Search Report for GB0206550.6 dated Nov. 12, 2002.

* cited by examiner

COMPONENT SUPPORT AND RADIOISOTOPE GENERATOR INCLUDING ONE OR MORE COMPONENT SUPPORTS

This application is a filing under 35 U.S.C. 371 of international application number PCT/GB02/05624, filed Dec. 11, 2002, which claims priority to application number 0206550.6 filed Mar. 20, 2002, in Great Britain the entire disclosure of which is hereby incorporated by reference.

FIELD OF INVENTION

The present invention relates to an interengaging component support which is particularly, but not exclusively, suited to implementation in a radioisotope generator of the type commonly used to generate radioisotopes such as technetium-99m ($^{99m}$Tc).

BACKGROUND OF THE INVENTION

The diagnosis and/or treatment of disease in nuclear medicine constitute one of the major applications of short-lived radioisotopes. It is estimated that in nuclear medicine over 90% of diagnostic procedures performed worldwide annually use $^{99m}$Tc labelled radio-pharmaceuticals. Given the short half-life of diagnostic radio-pharmaceuticals, it is helpful to have the facility to generate suitable radioisotopes on site. Accordingly, the adoption of portable hospital/clinic size $^{99m}$Tc generators has greatly increased over the years. Portable radioisotope generators are used to obtain a shorter-lived daughter radioisotope which is the product of radioactive decay of a longer-lived parent radioisotope, usually adsorbed on a bed in an ion exchange column. Conventionally, the radioisotope generator includes shielding around the ion exchange column containing the parent radioisotope along with means for eluting the daughter radioisotope from the column with an eluate, such as saline solution. In use, the eluate is passed through the ion exchange column and the daughter radioisotope is collected in solution with the eluate, to be used as required.

In the case of $^{99m}$Tc, this radioisotope is the principle product of the radioactive decay of $^{99}$Mo. Within the generator, conventionally the 99Mo is adsorbed on a bed of aluminium oxide and decays to generate $^{99m}$Tc. As the $^{99m}$Tc has a relatively short half-life it establishes a transient equilibrium within the ion exchange column after approximately twenty-four hours. Accordingly, the $^{99m}$Tc can be eluted daily from the ion exchange column by flushing a solution of chloride ions, i.e. sterile saline solution through the ion exchange column. This prompts an ion exchange reaction, in which the chloride ions displace $^{99m}$Tc but not 99Mo.

In the case of radio-pharmaceuticals, it is highly desirable for the radioisotope generation process to be performed under aseptic conditions i.e. there should be no ingress of bacteria into the generator. Moreover, due to the fact that the isotopes used and generated with the generator are radioactive, and are thereby extremely hazardous if not handled in the correct manner, the radioisotope generation process also should be conducted under radiologically safe conditions. Naturally, it is desirable to ensure that when the elution process is performed, the radiological safety of the generator is not compromised. In particular, when the eluate is introduced into the generator, it is important for the radiological safety of the generator to be maintained.

In trying to ensure adequate radiological protection, some known radioisotope generators have tended to be of a complicated construction incorporating a large number of components. However, the radiological protection afforded by such structures can be compromised where the interconnection of the various components is unreliable. Such complex structures also add to the cost of the generator. It is thus important that the actual construction of the generator is reliable and all component interconnections are secured to a high degree of certainty.

U.S. Pat. No. 3,946,238 describes a shielded radioisotope generator comprising a cylindrical shielded housing for a central repository. The repository is bound by a removable top cover and side walls and a base which are made from lead and which act as the shielding. Within the repository a bottle is located which contains an ion exchange column in which $^{99}$Mo is absorbed. When it is desired to add saline solution to the system to prompt the elution of $^{99m}$Tc, the top cover is removed, and the saline is introduced by way of a transfer pipette. The saline solution is introduced by means of the pipette to an annular region between the bottle and the inner surfaces of the shielding. From this annular region the saline solution flows in a controlled manner into the bottle containing the ion exchange bed via a series of radial openings in the wall of the bottle. The transfer pipette has a long handle designed such that a user's hands always remain outside the generator when saline is introduced into the annular region about the bottle. It is apparent, however, that the removal of the top cover for the purposes of introducing the saline solution constitutes an unacceptable radiological risk as the interior of the repository is radioactive.

U.S. Pat. No. 3,564,256 describes a radioisotope generator having quick-coupling members for the elution process. The generator includes a cylindrical holder containing a radioactive substance bound to an ion exchange bed. The holder is closed by rubber plugs at both ends, and is surrounded by shielding having passages opposite each of the rubber plugs in which respective needles are located. At the outermost ends of the needles quick-coupling members are provided to enable a syringe vessel containing a saline solution to be quickly and easily connected to one of the needles and to enable a collection vessel to be connected to the other of the two needles. In use, each one of the rubber plugs of the cylindrical holder is pierced by one of the needles to prompt the elution of $^{99m}$Tc from the ion exchange column. Suitable quick-coupling members proposed in the document are conventional detachable injection needle to injection syringe connections.

U.S. Pat. No. 4,387,303 describes a radioisotope generator comprising a column having an elute inlet aperture and an elute outlet aperture and containing an ion exchange bed with the parent radioisotope. Both the elute inlet and outlet are in communication with channels in the surrounding shielding. One of the channels, that is in communication with the elute outlet, is connected to a tapping point on the generator via an eluate conduit. The tapping point is adapted to receive an evacuated elution vial for collection of the daughter radioisotope in solution and consists of a hollow needle that pierces the seal to the evacuated elution vial. The eluate conduit is also in communication with a source of sterile air and the generator includes a device for interrupting the elution process before the elution vial is filled by interrupting the flow of sterile air. No information is provided with regard to the construction of the generator and in particular no information is provided as to how the hollow needle at the tapping point is held in position.

SUMMARY OF THE INVENTION

In view of the needs of the prior art, the present invention provides a component support for use in a radioisotope generator. The component support includes a latching member movable between an engaging position and an open position and further includes a bracing member mechanically associated with the latching member and adapted to prevent movement of the latching member to the open position.

DETAILED DESCRIPTION OF THE PREFERRED EMBODIMENTS OF THE INVENTION

Figure 1:
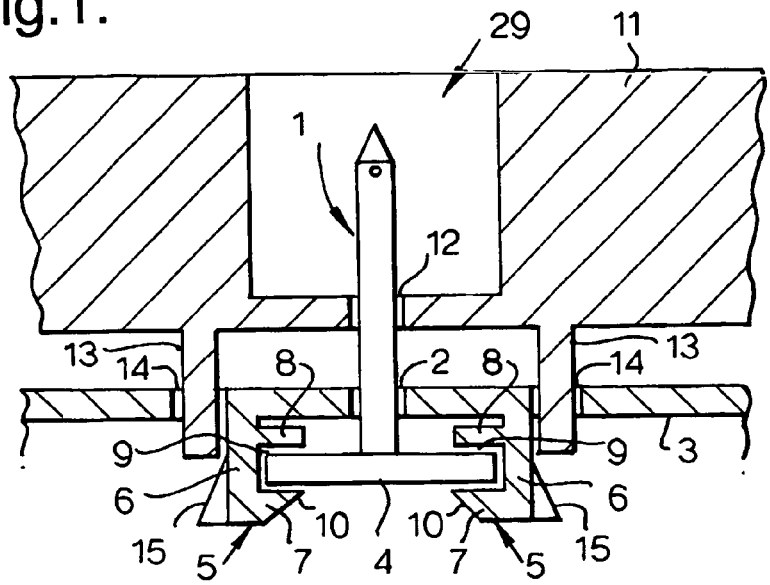
FIG. 1 depicts a component support in accordance with the present invention.

The present invention seeks to provide a component support that is simple in construction but provides greater reliability than existing simple component supports and so is particularly suited for use in radioisotope generators where there exists a need for a radioisotope generator that is simple in construction but which ensures the necessary degree of sterility and radiological protection.

According to a first aspect of the present invention, there is provided a component support for use in a radioisotope generator, the component support comprising a latching member movable between an engaging position and an open position characterised by further including a bracing member mechanically associated with the latching member and adapted to prevent movement of the latching member to the open position.

In a preferred embodiment of the present invention, the component support may include a first plate on which the latching member is mounted, with the first plate including an opening at or adjacent the latching member for receiving the bracing member. The opening in the first plate is preferably an aperture in the first plate adjacent the latching member on the side of the latching member facing the direction of movement of the latching member from the engaging position to the open position.

Preferably, the opening is of non-circular cross-section and the bracing member has a corresponding non-circular cross-section. Also, the latching member may additionally include a camming surface engageable by the bracing member for urging the latching member away from the open position.

More preferably the component support may also include a second plate on which the bracing member is mounted, the second plate being arranged to lie substantially parallel to the first plate when the bracing member is inserted through the opening in the first plate.

The latching member is preferably a generally L-shaped structure consisting of a wall and a flange projecting therefrom, and in a preferred embodiment the latching member also includes a second flange arranged substantially parallel to the first flange for defining a slot therebetween. It is envisaged but by no means essential that the component support comprises at least two opposing latching members and respective bracing members.

According to a second aspect of the present invention there is provided a radioisotope generator having one or more component supports as previously described. The latching member of the generator may be mounted on a closure plate of the generator which include an opening for receiving the bracing member, and wherein the bracing member is mounted on a cover plate of the generator such that insertion of the bracing member into the opening mounts the cover plate over the closure plate.

Preferably, the radioisotope generator has two latching members mounted on the closure plate either side of a central component aperture and wherein the cover plate also includes a component aperture for alignment with the component aperture in the closure plate. The radioisotope generator may also include a fluid port comprising a hollow generally cylindrical body and a retaining plate, the hollow body being received in the component apertures in the closure plate and the cover plate and the retaining plate being engaged by the opposed latching members for securely holding the fluid port in position.

In the preferred embodiment, the radioisotope generator includes a container consisting of a wall and a floor, with the opening to the container being closed by a closure plate. With this arrangement the latching member is located on the container wall and the closure plate includes a bracket for engagement with the latching member and an opening at or adjacent the bracket and the bracing member is provided on a cover plate such that insertion of the bracing member into the opening in the closure plate aligns the bracing member with the latching member thereby to prevent movement of the latching member to the open position.

Figure 2:
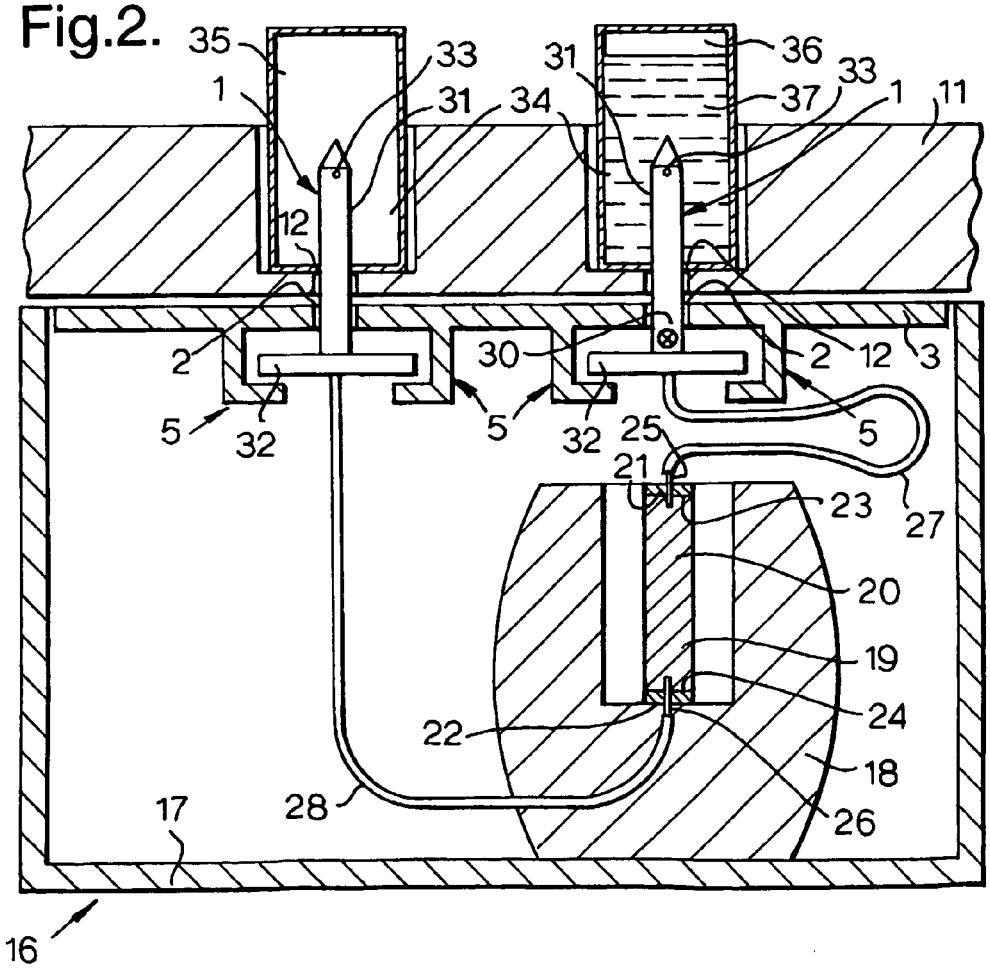
FIG. 2 depicts a radioisotope generator incorporating supports for tapping spikes in accordance with the present invention.

An embodiment of the present invention will now be described, by way of example only, with reference to the accompanying The component support is Illustrated generally by reference numeral 29, and the component illustrated in FIG. 1 is a spike 1 which projects through an aperture 2 in a plate 3 and has a planar mounting member 4 that is held in position by a pair of latching members 5. The latching members are movable between an engaging position in which they engage the planar mounting member and an open position in which the planar mounting member is not restrained by the latching members. Each of the pair of latching members 5 includes a wall 6 projecting outwardly from the surface of the plate 3 (downwardly as illustrated in FIGS. 1 and 2). The walls 6 are each spaced from the aperture 2 diametrically opposite one another across the aperture 2. A flange 7 is provided at the free end of each wall 6. The flanges 7 on each of the walls project away from the walls towards one another and extend substantially parallel to the plate 3. A second flange 8, substantially parallel to the first flange 7, is provided between the first flange 7 and the plate 3. The first 7 and second 8 flanges thus form a slot 9 suitable for receiving a planar member 4.

The plate 3 is preferably made from a hard plastics material and the walls 6 and flanges 7, 8 are preferably moulded as a single unit with the plate 3. This results in the walls 6 and flanges 7, 8 having a small degree of resiliency sufficient to be suitable for "snap-fit" engagement of a planar member within the slot 9 defined by the first 7 and second 8 flanges. For this reason, as illustrated in FIG. 1, the first flange 7 has a camming surface 10 facing away from the plate 3 for guiding and centering a planar member 4 towards the slot 9 and for urging the small amount of flexure of the opposed walls 6 necessary to permit the planar member 4 to pass the periphery of the first flange 7 whereupon the walls 6 'snap' back into position with the planar member 4 located and held in the slot 9 between the first and second flanges 7, 8.

Such a snap-fit connection is generally well-known and provides a particularly quick method for securing two elements (in this case the planar member 4 and the plate 3) together. However, the fact that this manner of securement demands a small degree of flexure of the walls 6, generally renders such a means of securement undesirable in circumstances where the securement must be highly reliable. An external force applied to the plate 3 is capable of causing flexure of the walls 6 to the extent that the planar member 4 is accidentally freed from the slot 9. For this reason, snap-fit connections have not been considered suitable in the construction of radioisotope generators.

The component supports 29 illustrated in FIGS. 1 and 2 however provide a greatly improved reliability of securement over convention snap-fit connectors, which renders the component supports 29 particularly suited for use in radioisotope generators. The component supports 29 include a cover 11 that is arranged to overlie the plate 3. The cover 11 has a component aperture 12 for alignment with the aperture 2 in the plate 3. The cover 11 also has a pair of bracing members 13 that project (downwardly in FIGS. 1 and 2) away from the cover 11. Also, adjacent each of the walls 6, on the opposite side of each of the walls 6 to the flanges 7, 8, respective brace apertures 14 are provided in the plate 3. The bracing members 13 on the cover 11 are positioned either side of the component aperture 12 so as to be aligned with the brace apertures 14 in the plate 3. The brace apertures 14 are sized to permit the passage of the bracing members 13 and preferably are non-circular in cross-section so that the bracing member 13 is keyed into the brace aperture 14. With the cover 11 positioned over the plate 3 and the bracing members 13 inserted into the brace apertures 14, the bracing members 13 are mechanically associated with the walls 6, and act as braces to the walls 6. This substantially prevents outward flexure of the walls 6. In this way, the reliability of the component support 29 is greatly enhanced.

In a particularly preferred embodiment, each associated wall 6 and bracing member 13 have co-operable camming surfaces and followers. In FIG. 1 the camming surface 15 is on the wall 6 facing towards the bracing member 13. This enables the bracing member 13 to actively engage with and urge the wall 6 inwardly towards the planar member 4 when inserted in the slot 9 defined by the first and second flanges 7, 8. This further improves the reliability of the securement of the component provided by the component supports 29.

FIG. 2 illustrates an implementation of the component supports in a radioisotope generator 16. The radioisotope generator 16 has an outer container 17, a closure plate, referred to herein as a top plate 3 which is sealingly secured to the outer container 17, and a separate top cover 11 which is secured to the outer container 17 over the top plate 3. Inside the outer container 17 a radioactive shield 18 is located which is preferably, but not exclusively, made from either lead or a depleted uranium core within a stainless steel shell. The radioactive shield 18 surrounds a tube 19 containing an ion exchange column 20. The ion exchange column 20 preferably consists of a mixture of aluminium and silica, onto which molybdenum in the form of its radioactive isotope, $^{99}$Mo is adsorbed. The tube 19 containing the ion exchange column 20 has frangible rubber seals 21 and 22 at opposing ends 23 and 24 which, as illustrated, when in use are pierced by respective hollow needles 25 and 26.

Each of the hollow needles 25 and 26 are in fluid communication with respective fluid conduits 27, 28 which in turn are in respective fluid communication with an eluent inlet and an eluate outlet. The fluid conduits 27, 28 are preferably flexible plastics tubing and in the case of the tubing 27 that communicates with the hollow needle 25 at the top 23 of the ion exchange column 20, the length of the tubing 27 is much greater than the minimum required to connect the hollow needle 25 with the eluent inlet.

The top plate 3 of the radioisotope generator 16 has a pair of apertures 2 through which the respective eluent inlet and eluate outlet components project. The eluent inlet and eluate outlet components are each hollow spikes 1 though in the case of the inlet component the hollow spike additionally includes a filtered air inlet 30. The hollow spike 1 consists of an elongate generally cylindrical spike body 31 and an annular retaining plate 32 which is attached to or is moulded as a single part with one end of the spike body 31. The opposing end of the spike body 31 is shaped to a point and has an aperture 33 communicating with the interior of the spike body 31 adjacent the point. This pointed end of the spike body 31 is shaped so that it is capable of piercing a sealing membrane of the type commonly found with sample vials. The annular retaining plate 32 forms a skirt projecting outwardly from the spike body 31 and may be continuous around the spike body 31 or discontinuous in the form of a plurality of discrete projections.

The top cover 11 of the radioisotope generator 16 also includes a pair of apertures 12 arranged so as to align with the apertures 2 in the top plate 3 and shaped to allow through passage of the spike body 31. Thus, each of the hollow spikes 1 is arranged to be held and supported by its annular retaining plate 32 by latching members 5 located on the inside of the top plate 3 whilst the hollow spike body 31 projects through the apertures in both the top plate 3 and the top cover 11 to the exterior of the outer container 17. Each one of the apertures 12 in the top cover 11 is located at the bottom of a well 34 that is shaped to receive and support either an isotope collection vial 35 or a saline supply vial 36. Thus, both vials 35, 36 are housed outside of the outer container 17 and are not exposed to radiation from the ion exchange column 20.

The hollow spikes 1 are held in place by the component supports 29 as described earlier with reference to FIG. 1. Thus, the spike body 31 projects through the aligned apertures in the top plate 3 and the top cover 11 and is securely held in position by engagement of the annular retaining plate 32 in the slot 9 defined by the first and second flanges 7, 8 of the latching members 5. Retention of the plate 32 in the slot 9 is maintained by the supporting action of the bracing members 13 outside of the walls 6 of the latching members 5 which substantially prevent outward flexure of the walls 6.

When the radioisotope generator 16 is constructed, the spike body 31 is inserted through the aperture 2 in the top plate 3 and the annular retaining plate 32 contacts the camming surfaces 10 on an opposing pair of first flanges 7. Further pressure applied to the retaining plate 32 forces outward flexure of the walls 6 supporting the first flanges 7 until the retaining plate 32 is able to pass the free end of the first flanges 7. Once the retaining plate 32 has passed the first flanges 7 the external pressure on the walls 6 is eased and the walls 6 'snap' back to their normal position locating the retaining plate 32 in the slots 9 defined by the first and second flanges 7 and 8. The top cover 11 is then positioned over the top plate 3 with the apertures 12 in the top cover 11 aligned with the spike body 31 and the bracing members 13 aligned with apertures 2 in the top plate 3 adjacent each of the walls 6. As the top cover 11 is brought into contact with the top plate 3 the bracing members 13 pass through the apertures 2 in the top plate 3 so as to be positioned next to, and preferably in contact with, the outer surfaces of the walls 6. The interaction of the bracing members 13 on the top cover 11 and the walls 6 of the top plate 3 thus provide reliable securement of the retaining plate 32 of the hollow spike 1 in the slot 9 defined by the first and second flanges 7, 8. The tubing 27 and 28 is then fluidly attached to the hollow spikes 1 and the outer container 17 is closed when the top plate 3 and the top cover 11 are secured to the container.

When it is desired to attach a vial 35 or 36 to the hollow spike 1, a user positions the frangible seal of the vial over the pointed end of the spike and pushes the vial down onto the spike 1. This causes the seal on the vial 35 or 36 to be pierced establishing fluid communication between the spike 1 and the vial. Once the seal has been pieced by the spike 1, the vial is pushed down over the spike 1 until it rests and is supported by the well 34 in the top cover 11.

In order to supply the ion exchange column 20 with the chloride ions required for elution of the radioisotope, saline solution 37 is drawn through the ion exchange column 20, by establishing a pressure differential across the ion exchange column 20. This is accomplished by connecting the saline supply vial 36 to the eluent inlet which is in fluid communication with the top end 23 of the ion exchange column 20 via the tubing 27 and hollow needle 25 and connecting an evacuated collection vial 35 to the eluate outlet which is in fluid communication with the bottom end 24 of the ion exchange column 20 via the tubing 28 and hollow needle 26. The pressure differential is established by virtue of the fluid pressure of the saline in the supply vial 36 and the extremely low pressure in the evacuated collection vial 35. This urges passage of the saline solution 37 through the ion exchange column 20 to the collection vial 35 carrying with it the daughter radioisotope.

The component support is simple in design but by the interaction of the bracing member on one plate with the wall of the snap-fit component on the other plate and highly reliable component support is provided. Although reference has been made in the description to a component support suitable for a hollow spike, it will be apparent that the component support of the present invention may be employed with alternative components that are intended to be secured in a snap-fit holder.

For example, the component support may be used as a means for attaching the top plate to the outer container of the radioisotope generator. With this arrangement, latching members are attached to the inner side walls of the outer container. Each latching member is spaced from the wall of the outer container by means of a bridge element so as to define a bracket receiving region between the latching member and the wall of the container. Thus, the wall of the latching member is arranged substantially parallel to the container wall and the slot defined by the paired flanges mounted on the wall of the latching member lies substantially perpendicular to the container wall. This arrangement also requires the top plate to have an equivalent number of brackets for location and engagement with respective latching members. Thus, as the top plate is lowered into position, the bracket attached to the periphery of the top plate and projecting downwardly therefrom, engages the first of the flanges on the latching member. The bracket urges the latching member to flex away from the container wall thereby enlarging the bracket receiving region until the bracket is capable of passing the periphery of the flange whereupon the latching member snaps back into position trapping part of the bracket in the slot defined by the two flanges. As described previously, the bracing member projects from the top cover and is locatable in an aperture in the top plate, such that, as before, it is mechanically associated with the latching member and acts to brace the latching member against flexure.

It is not a requirement of the present invention that the bracing means is locatable through an aperture in the top plate such that it acts as an exterior abutment to the component support wall. For example, it is alternatively envisaged that the component support wall may include a blind bore, into which the bracing means is inserted, to provide the desired improved support for the latching member.

Moreover, it is not a requirement of the present invention that the plates of the component support contain apertures through which the component passes. Instead, the component may extend away from the surface of the first plate bearing the walls of the component support (in the illustrated embodiment the top plate 3) in which case the second plate (in the illustrated embodiment the top cover 11) need only align the bracing members with the brace apertures in the first plate. Furthermore, although paired flanges defining a slot are illustrated above, it will be appreciated that the slot may be defined between a single flange and the surface of the first plate. Further and alternative features of the component support are envisaged without departing from the scope of the present invention as claimed.

What is claimed is:

1. A component support comprising a plate and a cover, wherein:

said plate further comprises a substantially planar plate body defining a spike aperture therethrough, said plate body further comprising first and second opposed deflectable latches extending to either side of said spike aperture, said plate body further defining first and second bracing apertures adjacent to said first and second latches, respectively;

said cover further comprises a planar cover body comprising first and second bracing members insertable through said first and second bracing apertures of said plate body so as to prevent deflection of said first and second latches, respectively, said cover body further defining a spike passageway therethough so as to extend in overlying registry with said spike aperture of said plate body when said bracing members extend through said bracing apertures.

2. A component support of claim 1, wherein said cover body further defines a cylindrical bore in fluid communication with said spike passageway, said cylindrical bore being further across in dimension than said spike passageway so as to accommodate a vial therein.

3. A component support of claim 2, wherein said plate body further defines a second spike aperture therethrough, said plate body further comprising third and fourth opposed deflectable latches extending to either side of said second spike aperture, said plate body further defining third and fourth bracing apertures adjacent to said third and fourth latches, respectively; and wherein said cover further third and fourth bracing members insertable through said third and fourth bracing apertures of said plate body so as to prevent deflection of said third and fourth latches, respectively, said cover body further defining a second spike passageway therethough so as to extend in overlying registry with said second spike aperture of said plate body when said third and fourth bracing members extend through said third and fourth bracing apertures, respectively.

4. A component support of claim 3, wherein said cover body further defines a second cylindrical bore in fluid communication with said second spike passageway, said second cylindrical bore being further across in dimension than said second spike passageway so as to accommodate a vial therein.

5. A component support as claimed in claim 1 wherein said first and second bracing apertures are of non-circular cross-section and said first and second bracing members have a corresponding non-circular cross-section.

6. A component support as claimed in claim 1 wherein said first and second latches each further comprise a camming surface engageable by said first and second bracing member, respectively, for urging said first and second latches towards each other.

7. A radioisotope generator including one or more component supports as claimed in claim 1.

8. A radioisotope generator as claimed in claim 7, wherein said plate body is a closure plate of the generator and is said cover body is a cover plate of said generator such that insertion of said bracing members into said bracing apertures mounts said cover plate over said closure plate.

9. A radioisotope generator as claimed in 8, further including a spike comprising a hollow generally cylindrical body and a retaining plate, said hollow body being received in said spike apertures in said closure plate and said spike passageway of said cover plate and wheein said retaining plate is engaged by said opposed first and second latches for securely holding said spike in position.

* * * * *